US010551017B2

(12) United States Patent
Jurik et al.

(10) Patent No.: US 10,551,017 B2
(45) Date of Patent: Feb. 4, 2020

(54) LIGHT CONTROL SYSTEM FOR A LUMINAIRE UTILIZING A LAMP WITH INTENSE HOTSPOT

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 15/137,780

(22) Filed: Apr. 25, 2016

(65) Prior Publication Data

US 2017/0108187 A1 Apr. 20, 2017

Related U.S. Application Data

(63) Continuation of application No. 14/042,759, filed on Oct. 1, 2013, now abandoned.

(51) Int. Cl.

| | |
|---|---|
| ***F21S 10/00*** | (2006.01) |
| ***F21V 5/00*** | (2018.01) |
| ***F21V 7/08*** | (2006.01) |

(52) U.S. Cl.
CPC ..... *F21S 10/007* (2013.01); *F21V 5/008* (2013.01); *F21V 7/08* (2013.01)

(58) Field of Classification Search
CPC ..... F21S 10/007; F21V 5/008; F21V 7/08
USPC ..... 362/282
See application file for complete search history.

(56) References Cited

U.S. PATENT DOCUMENTS

| | | | | |
|---|---|---|---|---|
| 4,151,584 | A | 4/1979 | Labrum | |
| 6,241,366 | B1 | 6/2001 | Roman et al. | |
| 9,261,269 | B2 | 2/2016 | Junk et al. | |
| 2002/0075685 | A1 | 6/2002 | Rasmussen et al. | |
| 2003/0151836 | A1 | 8/2003 | Davis | |
| 2007/0211468 | A1 | 9/2007 | Allegri | |
| 2011/0110099 | A1* | 5/2011 | Quadri | F21S 10/007 362/308 |

(Continued)

FOREIGN PATENT DOCUMENTS

WO 2010109385 A1 9/2010

OTHER PUBLICATIONS

Office Action dated Mar. 12, 2015; U.S. Appl. No. 14/042,758, filed Oct. 1, 2013; 10 pages.

(Continued)

*Primary Examiner* — Bao Q Truong
*Assistant Examiner* — Hana S Featherly
(74) *Attorney, Agent, or Firm* — Conley Rose, P.C.; Grant Rodolph; Brooks W Taylor

(57) ABSTRACT

Automatic light control system for a Luminaire with a light source and beam forming light collector with and intense hotspot. The Luminaire automatically selects a large aperture when a gobo is selected. When no gobo is selected then a medium aperture is automatically selected. In some embodiments these selections can be overridden. In some embodiments the large and medium aperture are on a non-glass gobo wheel. In further embodiments, when blackout is selected, this wheel automatically advances ½ position or 1 and ½ position so as to support a blackout state of the fixture until a non-blackout condition is selected.

12 Claims, 7 Drawing Sheets

(56) References Cited

U.S. PATENT DOCUMENTS

| | | | |
|---|---|---|---|
| 2015/0092418 | A1 | 4/2015 | Jurik et al. |
| 2015/0092422 | A1 | 4/2015 | Junk et al. |

OTHER PUBLICATIONS

Notice of Allowance dated Oct. 7, 2015; U.S. Appl. No. 14/042,758, filed Oct. 1, 2013; 8 pages.
Office Action dated Mar. 23, 2015; U.S. Appl. No. 14/042,759, filed Oct. 1, 2013; 10 pages.
Final Office Action dated Oct. 23, 2015; U.S. Appl. No. 14/042,759, filed Oct. 1, 2013; 11 pages.

* cited by examiner

LIGHT CONTROL SYSTEM FOR A LUMINAIRE UTILIZING A LAMP WITH INTENSE HOTSPOT

CROSS-REFERENCE TO RELATED APPLICATIONS

This application is a continuation of U.S. patent application Ser. No. 14/042,759 filed on Oct. 1, 2013.

TECHNICAL FIELD OF THE DISCLOSURE

The present disclosure generally relates to an automated luminaire, specifically to a light control system in an automated luminaire.

BACKGROUND OF THE DISCLOSURE

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape, and beam pattern. The beam pattern is often provided by a stencil or slide called a gobo which may be a steel, aluminum, or etched glass pattern. The products manufactured by Robe Show Lighting such as the Robin MMX Spot are typical of the art.

The optical systems of such automated luminaires may be designed such that a very narrow output beam is produced so that the units may be used with long throws or for almost parallel light laser like effects. These optics are often called 'Beam' optics. To form this narrow beam with the large light sources in the prior art, the output lens either needed to be very large with a large separation between the lens and the gobos or of a short focal length and much closer to the gobos. It is problematic to use a large separation with a large lens as such an arrangement makes the luminaire large and unwieldy, and makes automation of the pan and tilt movement difficult. Thus, the normal solution is a closer and smaller lens with a short focal length. Alternatively, the thick heavy front lens may be replaced with a Fresnel lens where the same focal length is achieved with a much lighter molded glass lens using multiple circumferential facets. Fresnel lenses are well known in the art and can provide a good match to the focal length of an equivalent plano-convex lens, however the image projected by such a lens is typically soft edged and fuzzy and not a sharp image as may be desired when projecting gobos or patterns.

FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drive systems and control electronics (not shown). In addition to being connected to mains power either directly or through a power distribution system (not shown), each luminaire is connected in series or in parallel to data link 14 to one or more control desks 15. The luminaire system 10 is typically controlled by an operator through the control desk 15. Control of the automated luminaire 12 is effectuated by electromechanical devices within the automated luminaire 12 and electronic circuitry 13, including firmware and software within the control desk 15 and/or the automated luminaire 12. In many of the figures herein, important parts like electromechanical components such as motors and electronic circuitry, including software and firmware and some hardware, are not shown in order to simplify the drawings so as to teach how to practice the disclosures taught herein. Persons of skill in the art will recognize the need for these parts and should be able to readily fill in these parts.

FIG. 2 illustrates a prior art automated luminaire 12. A lamp 21 contains a light source 22 which emits light. The light is reflected and controlled by reflector 20 through a hot mirror 23, aperture or imaging gate 24, and optical devices 25, 27 which may include dichroic color filters, effects glass, and other optical devices well known in the art. Optical device 27 is the imaging component and may include gobos, rotating gobos, irises and framing shutters. The final output beam may be transmitted through focusing lens 28 and output lens 29. Output lens 29 may be a short focal length glass lens or equivalent Fresnel lens as described herein. Either optical device 27, focusing lens 28, or output lens 29 may be moved backwards and forwards along the optical axis to provide focus and/or beam angle adjustment for the imaging components. Hot mirror 23 is required to protect the optical devices 25 and 27 from high infra-red energy in the light beam and typically comprises a glass plate with a thin film dichroic coating designed to reflect long wavelength infra-red light radiation and only allow the shorter wavelength, visible, light to pass through and into the optical system.

More recently lamps 21 with extremely small light sources 22 have been developed. These often use a very short arc gap, of the order of 1 millimeter (mm), between two electrodes as the light producing means. These lamps are ideal for producing a very narrow beam as their source etendue is low, and the size of the lenses and optical systems to collimate the light from such a small source can be substantially reduced. However, the short arc and small light source coupled with the short focal length, and thus large light beam angles, of the reflector also tend to produce substantial amounts of unwanted and objectionable light spill which can escape between gobos or around the dimming shutters.

There is an increased need for an improved light control system for an automated luminaire utilizing a light source with an intense hotspot such that light spill around or between gobos and/or through the dimming shutter is reduced.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE INVENTION

Preferred embodiments of the present disclosure are illustrated in the FIGUREs, like numerals being used to refer to like and corresponding parts of the various drawings.

The present disclosure generally relates to an automated luminaire, specifically to the design and operation of a light control system for use within the automated luminaire utilizing a light source with an intense hotspot, such that light spill around or between gobos and/or through the dimming shutter is reduced.

Figure 1:
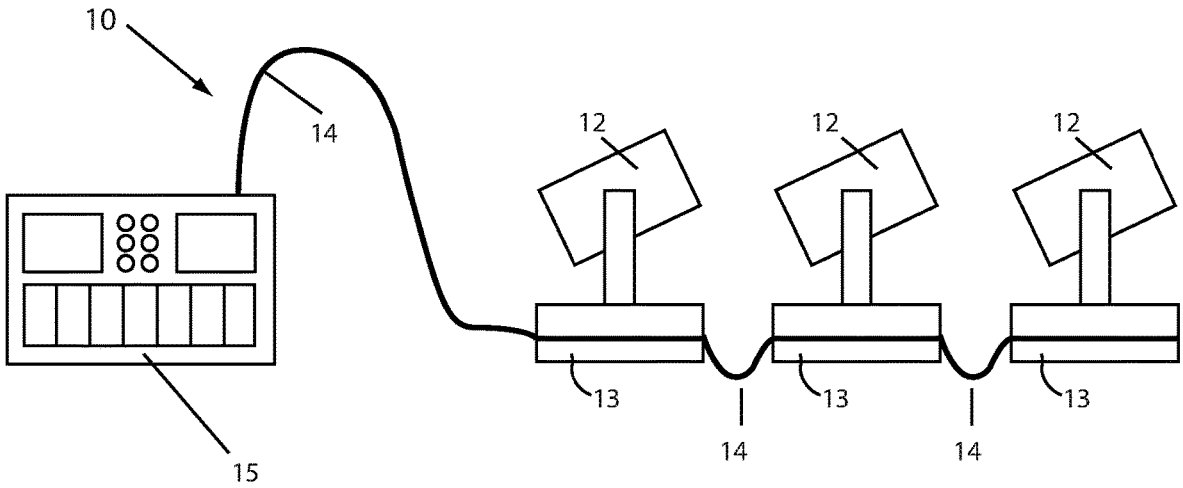
FIG. 1 illustrates a multiparameter automated luminaire system.
Figure 2:
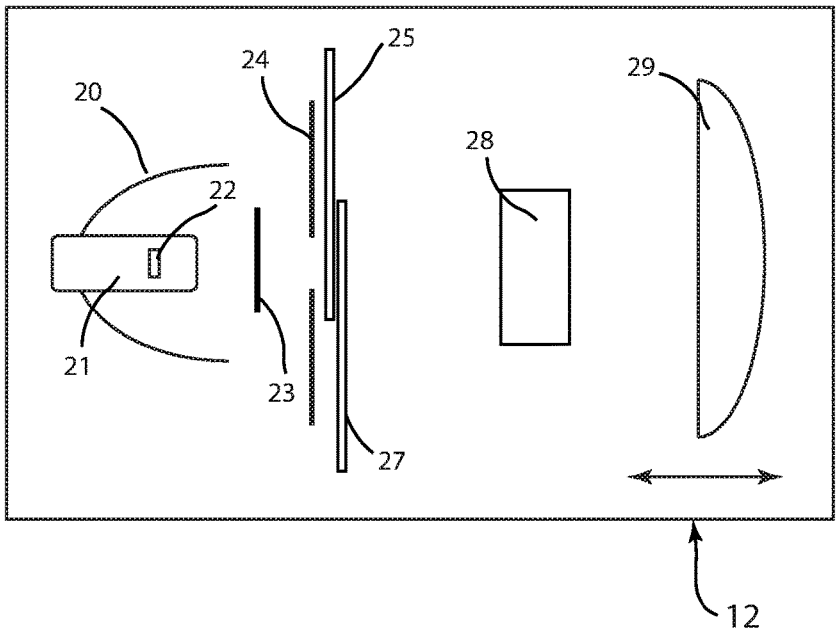
FIG 2 Prior art
FIG. 2 illustrates a prior art automated luminaire.
Figure 3:
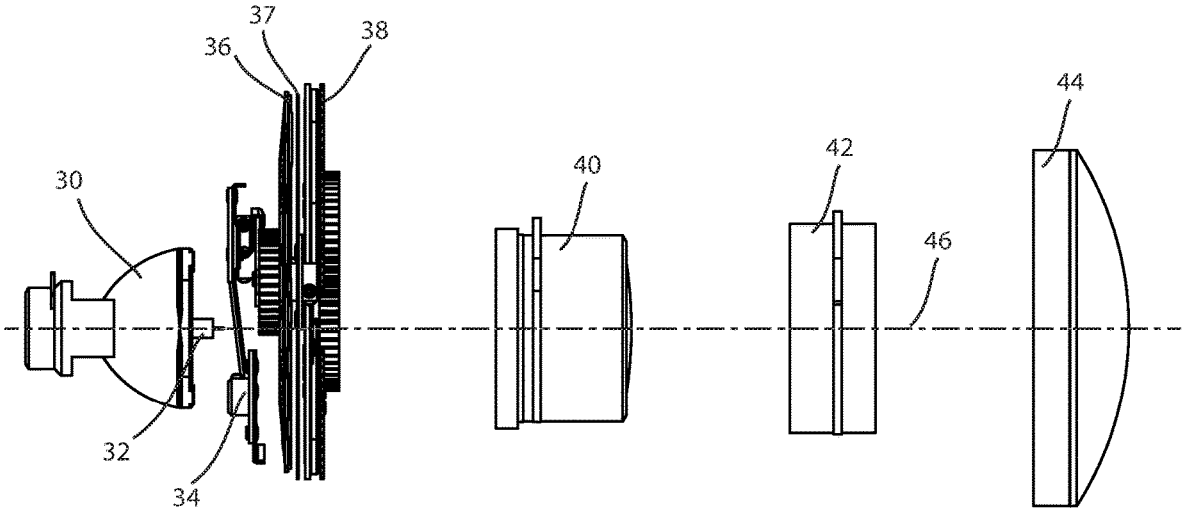
FIG. 3 illustrates an embodiment of an improved light control system for automated luminaires with high hot spot, non-even beam profiles and gobos.

FIG. 3 illustrates an embodiment of an improved light control system for automated luminaires with high hot spot, non-even beam profiles and gobos. The automated luminaire contains a light source 32 within reflector 30. Light source 32 may be a short arc discharge lamp with an arc length of approximately 1 mm, and reflector 30 may be an ellipsoidal glass reflector. The combination of a short arc light source and an ellipsoidal reflector is well known in the art and produces a light beam towards the second focus of the ellipsoidal reflector. Such a beam typically has a very high energy beam center, or hotspot, which can be damaging to downstream optics and also produces a poor wide beam pattern when trying to use the luminaire as a wash light. The light beam passes through the heat protection and homogenization system 34 before passing through optical systems such as, for example, color system 36, static gobo system 37, and rotating gobo system 38. The light beam then continues through lenses 40, 42, and 44 which may each individually or cooperatively be capable of movement along optical axis 46 so as to alter the focus and beam angle or zoom of the light beam.

Figure 4:
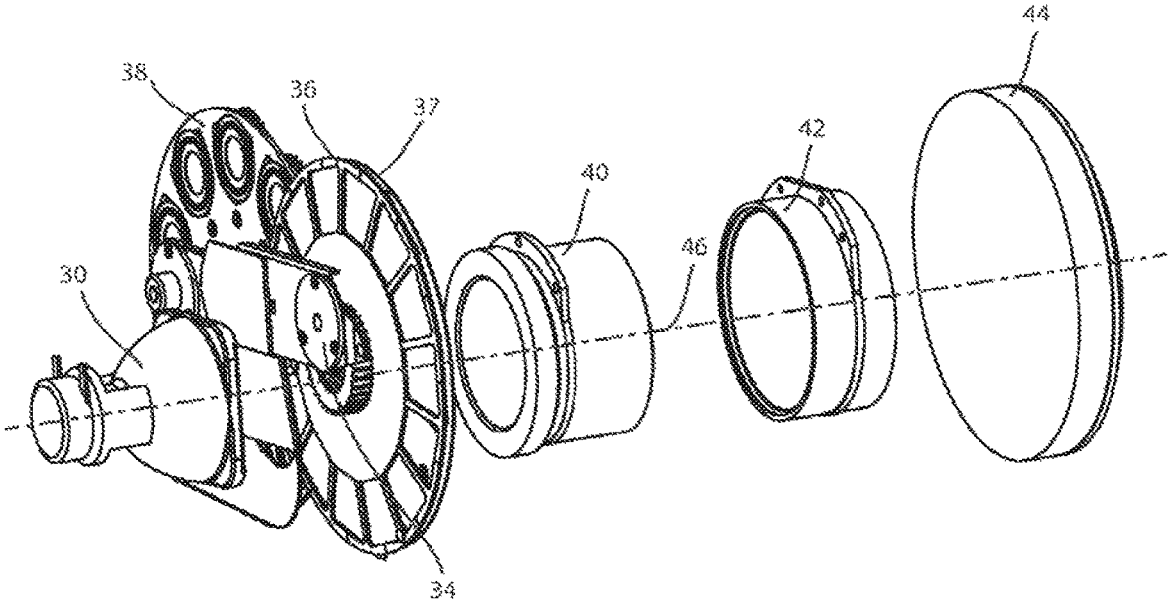
FIG. 4 illustrates an isometric view of an embodiment illustrated in FIG. 3.

Because of the short focal length of the light source 32 and reflector 30 the light beam passing through the static gobo system 37 and rotating gobo system 38 is sharply diverging, far from a parallel beam. This diverging beam provides increased possibility for light spill through one gobo on the first wheel past the edges of another gobo on the second wheel. FIG. 4 illustrates an isometric view of an embodiment illustrated in FIG. 3, which more clearly shows the gobo wheels provided in the light control system. The light control system utilizes coordinated control of the static gobo system 37 and rotating gobo system 38 in order to minimize light spill.

Figure 5:
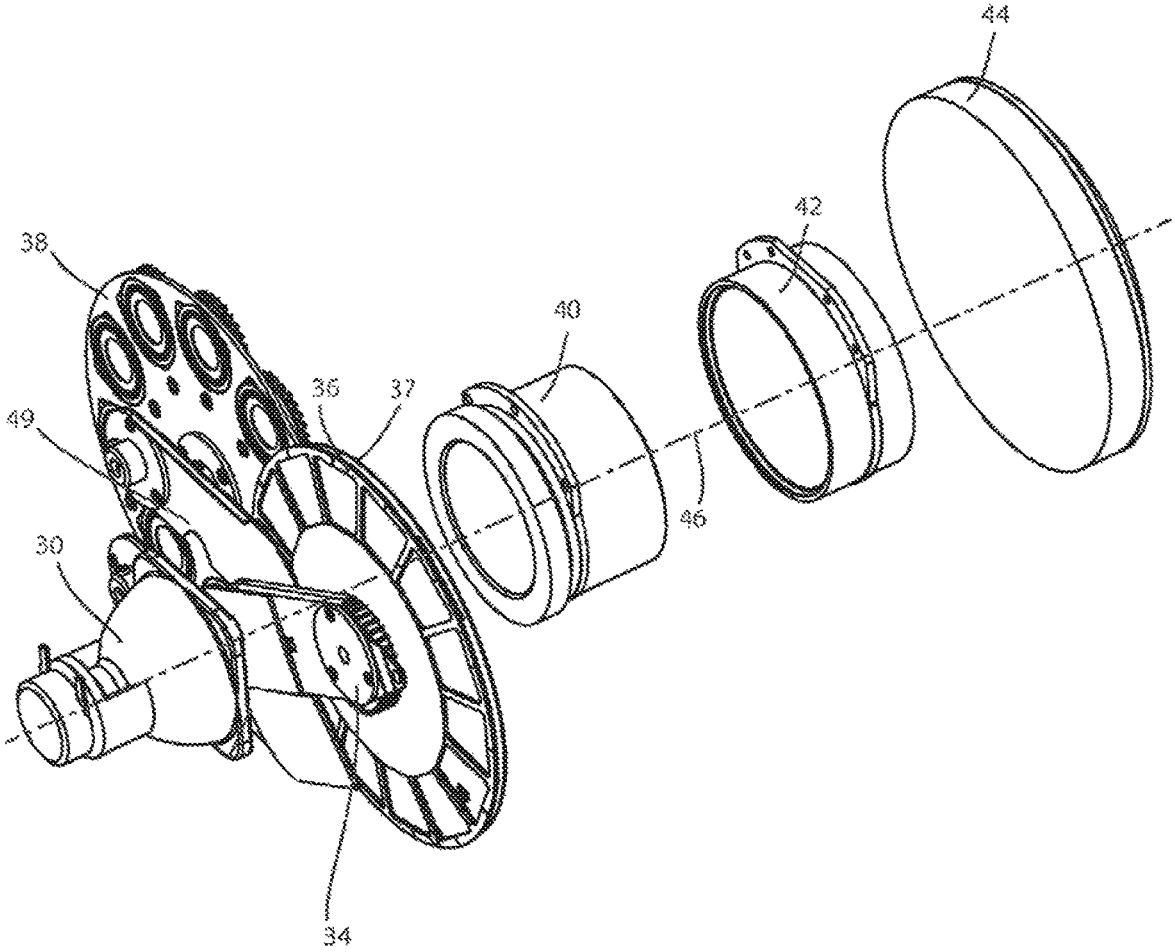
FIG. 5 illustrates an isometric view of the embodiment illustrated in FIG. 3.

FIG. 5 illustrates an isometric view of an embodiment of illustrated in FIG. 3, which more clearly shows the dimmer shutter 49 as well as the static gobo system 37 and rotating gobo system 38.

Figure 6:
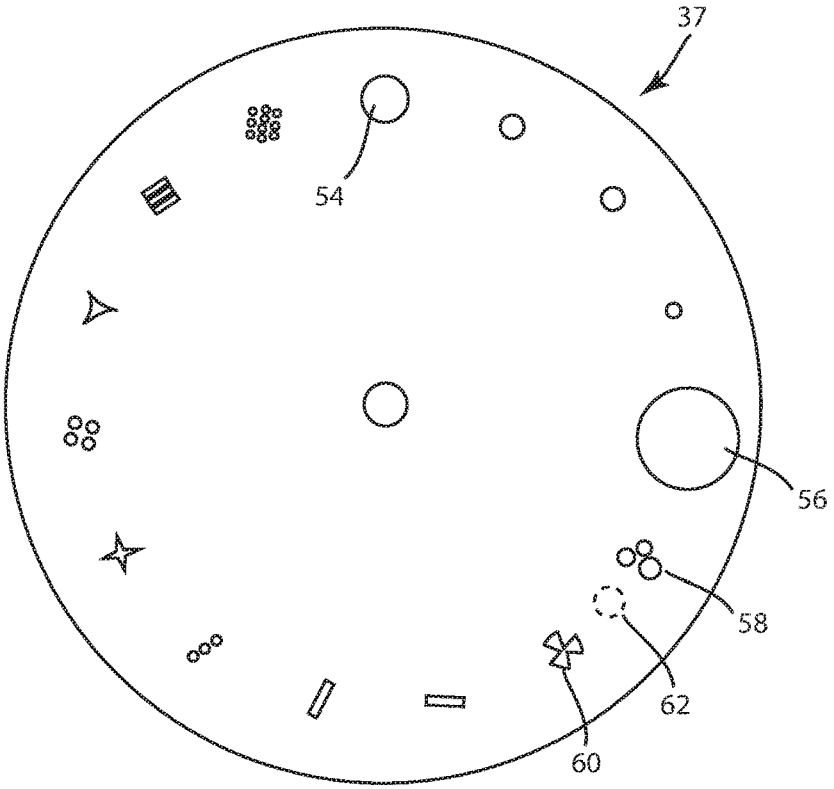
FIG. 6 illustrates a detailed view of the static gobo system illustrated in FIG. 3.
Figure 7:
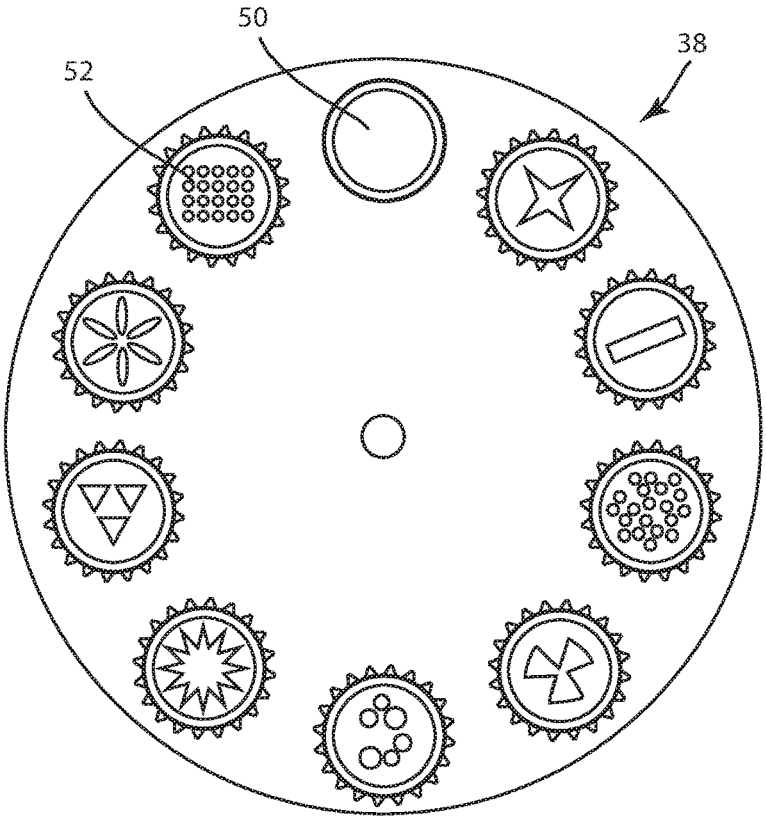
FIG. 7 illustrates a detailed view of the rotating gobo system embodiment illustrated in FIG. 3.

FIGS. 6 and 7 illustrate detailed views of the static gobo system 37 and rotating gobo system 38. Static gobo system 37 contains a plurality of patterns or gobos such as 58 and 60. It further contains a range of sizes of circular apertures including large aperture 56 and medium aperture 54. Similarly, rotating gobo system 38 contains a plurality of patterns or gobos such as 52 each of which may be rotated about its central axis. It also contains a full aperture 50 with no pattern or gobo, usually called the open hole.

In operation the light control system coordinates the use of the large aperture 56 and medium aperture 54 on the static gobo system 37 with the movement of the rotating gobo system 38 in order to minimize light spill. If the user is only utilizing the fixed gobo system 37 and the rotating gobo system 38 is positioned such that the open hole 50 is across the light path, then the system will utilize the medium aperture 54 as being the open hole for that wheel. In such case the large aperture 56 cannot be selected by the user and the system will avoid it when the wheel is rotated. The use of the medium aperture 54 instead of the large aperture 56 avoids excessive light spill from the large aperture 56 which could create haloes and patterns in the light beam. However, as soon as the user selects any gobo on rotating gobo system 38 other than the open hole 50, such as gobo 52, then the static gobo system 37 will automatically rotate from the medium aperture 54 to the large aperture 56 as its open hole. The use of the large aperture 56 on static gobo wheel in conjunction with any gobo other than the open aperture on the rotating gobo wheel results in improved light output through the rotating gobo wheel and, because a rotating gobo is in place, the risk of light spill is minimized.

Figure 8:
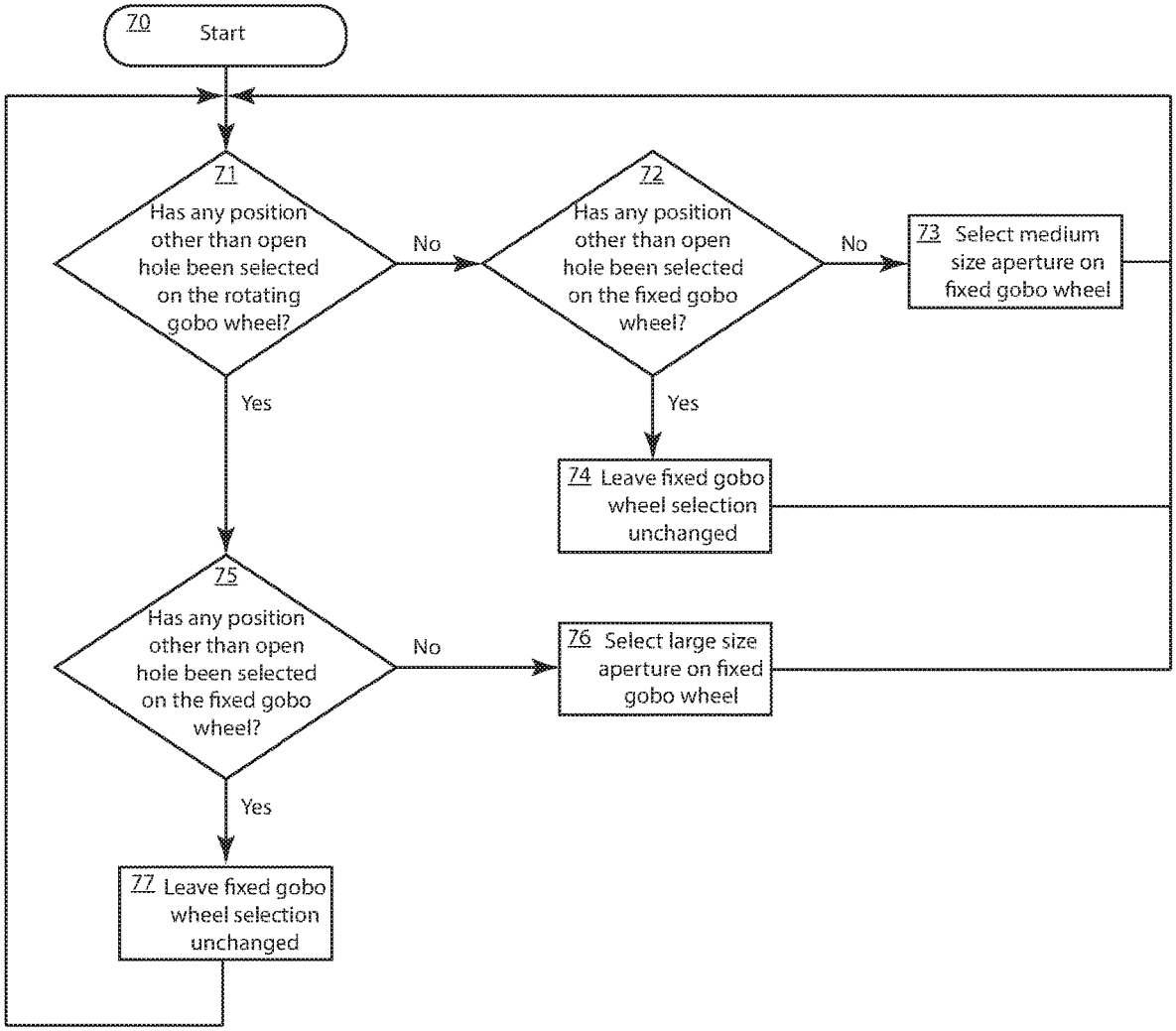
FIG. 8 illustrates a logic flow chart for controlling the light control system where the aperture size is automatically selected based on selections of the rotating and static gobos.

FIG. 8 illustrates a logic flow chart which clarifies the algorithm by which the software in the automated light will determine the relative automatic movements of the static gobo system 37 and rotating gobo system 38 to use the appropriate sized aperture as the open hole on the fixed gobo system 37. Such a system provides an advantage to the user in that it maximizes the light output from the system when using rotating gobos while minimizing light spill at all times, with any combination of static and rotating gobos.

Starting at step 70, if another position other than open hole is selected on the rotating gobo wheel at step 71 and another position other than open hole is selected on the fixed wheel at step 75, then the fixed wheel position is retained at step 77, and the inquiry repeats at steps 71.

If another position other than open hole is selected on the rotating gobo wheel at step 71, and there is no selection other than open hole on the fixed wheel at step 75, then the large size aperture on the fixed wheel is automatically selected at step 76 and the inquiry repeats at step 71.

If there is no position other than open hole selected on the rotating gobo wheel at step 71, and another position other than open hole is selected on the fixed wheel at step 72, then the fixed wheel position is retained at step 74 and the inquiry repeats at step 71.

If there is no position other than open hole selected on the rotating gobo wheel at step 71 and there is no selection other than open hole on the fixed wheel at step 72, then the medium size aperture on the fixed wheel is automatically selected at step 73 and the inquiry repeats at step 71.

In a further embodiment of the disclosure, the light control system makes further use of the static gobo wheel system 37 to minimize light spill from the luminaire when it is dimmed to blackout. The discharge lamps used in automated luminaires such as those used in light source 32 shown herein cannot typically be electrically dimmed to a full blackout. Enough current has to be left running to maintain the arc discharge. Thus, to obtain a full blackout of the luminaire, a secondary dimming or shutter system such as dimmer shutter 49 must be provided. These systems are typically mechanical, utilizing blades, shutters, irises diaphragms, or similar devices well known in the art to selectively restrict light from the optical system thus dimming it. At the extreme position of such a mechanical dimmer the shutter or blade may be completely across the light beam. However, with the short arc, short focal length lamps described herein, extreme angle light may still be able to escape through or around the dimmer system resulting in objectionable ghosting of stray light and an incomplete blackout. The light control system described recognizes when the mechanical dimmer is in its minimum, or blackout position, and automatically moves the static gobo system 37 to the nearest position intermediate between two patterns or gobos thus providing a secondary block to stray light. For example, as shown in FIG. 6, if the static gobo wheel is in position such that gobo 58 is being used and is across the light beam and the user issues the command to black out the luminaire, then the light control system will automatically move static gobo wheel system 37 to position 62 that is intermediate between gobos 58 and 60. This is a position where no light can pass through the wheel so that it provides a secondary block to spill light. Similarly, for any other position on the static gobo wheel system 37, on receiving the blackout command the wheel will rotate one half of a step to the closest intermediate position between two gobos. This small rotation may happen very quickly and is not noticeable to the user or the audience. Upon opening the dimmer again and coming out of blackout, the static gobo wheel system 37 will return to its original position.

Figure 9:
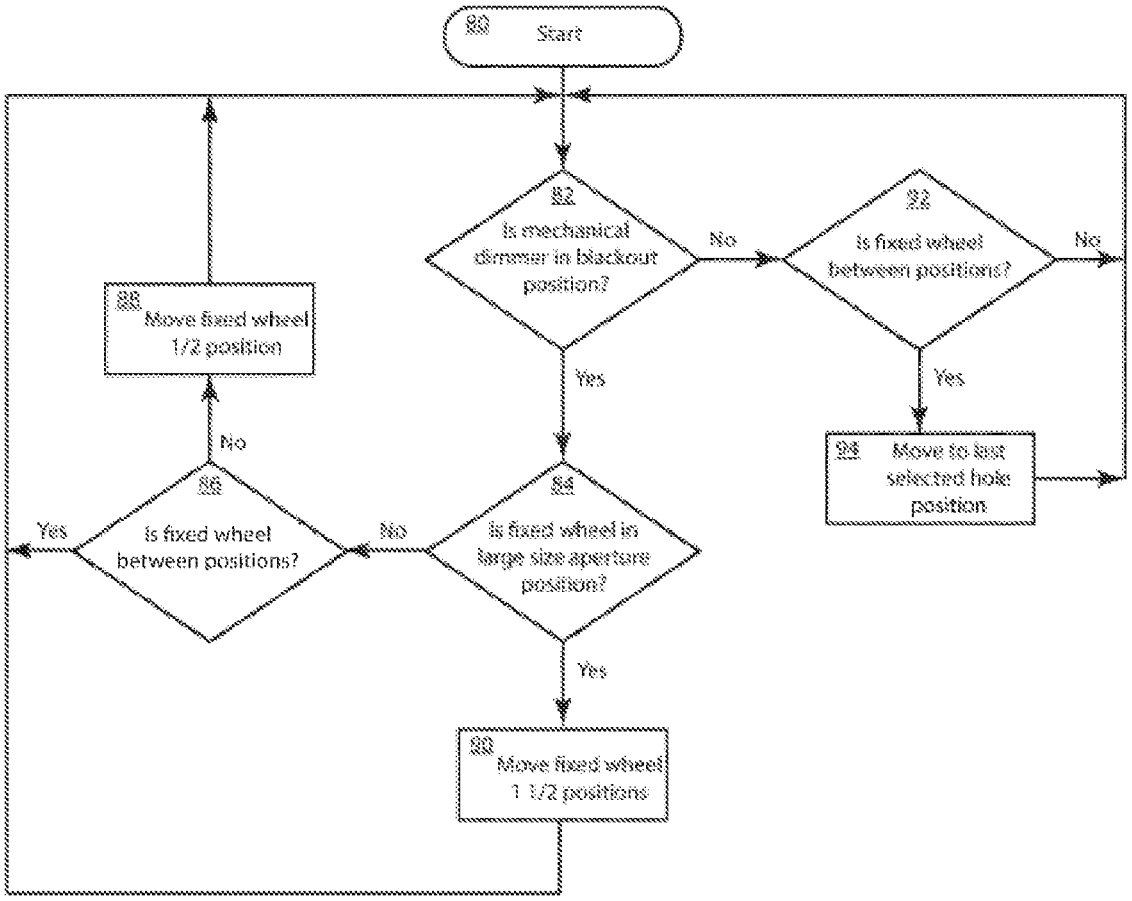
FIG. 9 illustrates a logic flow chart for controlling the light control system during a mechanical blockout.

FIG. 9 illustrates a logic flow chart for controlling the light control system during a mechanical blackout. Starting at step 80, if the mechanical dimmer is in a blackout position at step 82 and the fixed wheel is in the large aperture position at step 84, then the fixed wheel is moved 1 and ½ positions at step 90 so it is between gobo positions and the inquiry repeats.

If the mechanical dimmer is in a blackout position at step 82 and the fixed wheel is not in the large aperture position at step 84, then (1) if the fixed wheel is between positions at step 86 then the inquiry repeats or (2) if the fixed wheel is not between positions at step 86 then the fixed wheel is moved ½ position at step 88 so it is between gobo positions, and the inquiry repeats.

If the mechanical dimmer is NOT in a blackout position at step 82 and the fixed wheel is NOT between gobo positions at step 92 the inquiry repeats.

If the mechanical dimmer is NOT in a blackout position at step 82 and the fixed wheel is between gobo positions at step 92 then the fixed wheel is returned to the last user or automatically selected hole position at step 94 and the inquiry repeats.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

We claim:

1. An automated luminaire comprising:

a light source;

a first gobo wheel configured to receive a light beam produced by the light source, wherein the first gobo wheel comprises a large aperture position, a medium aperture position, and a plurality of first gobo positions;

a second gobo wheel configured to receive the light beam after it passes through the first gobo wheel, wherein the second gobo wheel comprises an open position and a second gobo position; and a control system configured to:

make a first determination that the first gobo wheel is in the large aperture position and the second gobo wheel is in the open position;

move the first gobo wheel to the medium aperture position in response to making the first determination;

make a second determination that the first gobo wheel is in the medium aperture position and the second gobo wheel is in the second gobo position; and move the first gobo wheel to the large aperture position in response to making the second determination.

2. The automated luminaire of claim 1, wherein the second gobo wheel comprises at least one rotating gobo.

3. The automated luminaire of claim 1, wherein at least one of the first gobo wheel and the second gobo wheel comprises a glass gobo.

4. The automated luminaire of claim 1, wherein at least one of the first gobo wheel and the second gobo wheel comprises an etched metal gobo.

5. The automated luminaire of claim 1, further comprising a mechanical dimmer having a blackout position, wherein the control system is configured to move the first gobo wheel to a blackout gobo position between two of the plurality of first gobo positions when the mechanical dimmer is moved to the blackout position.

6. The automated luminaire of claim 5, wherein the blackout gobo position is either ½ or 1½ positions away from a current position of the first gobo wheel.

7. The automated luminaire of claim 5, wherein the control system is configured to:

store a current position of the first gobo wheel prior to moving the first gobo wheel to the blackout gobo position; and move the first gobo wheel to the stored position when the mechanical dimmer is next moved to a position other than the blackout position.

8. The automated luminaire of claim 1, wherein the control system is configured not to move the first gobo wheel to the large aperture position while the second gobo wheel is in the open position.

9. The automated luminaire of claim 1, further comprising a mechanical dimmer having a blackout position, wherein the control system is configured to:

make a fourth determination that the mechanical dimmer is in the blackout position; and move the first gobo wheel to a blackout gobo position between the medium aperture position and an adjacent one of the plurality of first gobo positions in response to making the fourth determination.

10. An automated luminaire comprising:

a light source;

a mechanical dimmer configured to receive a light beam produced by the light source, wherein the mechanical dimmer has a blackout position;

a gobo wheel configured to receive a light beam that passes through the mechanical dimmer, wherein the gobo wheel comprises a large aperture position, a medium aperture position, and one or more gobo positions; and a control system configured to:

make a first determination that the mechanical dimmer is in the blackout position; and move the gobo wheel to a blackout gobo position in response to making the first determination, wherein the blackout gobo position comprises either (i) a position between two of the gobo positions or (ii) a position between the medium aperture position and one of the gobo positions.

11. The automated luminaire of claim 10, wherein the blackout gobo position is one of ½ and 1½ positions away from a current position of the gobo wheel.

12. The automated luminaire of claim 10, wherein the control system is configured to:

store a current position of the gobo wheel prior to moving the gobo wheel to the blackout gobo position in response to making the first determination;

make a second determination that the mechanical dimmer is in a position other than the blackout position and the gobo wheel is in the blackout gobo position; and move the gobo wheel to the stored position in response to making the second determination.

* * * * *